US006182708B1

(12) United States Patent
Smissaert

(10) Patent No.: US 6,182,708 B1
(45) Date of Patent: Feb. 6, 2001

(54) METHOD FOR WEAVING FACE-TO-FACE CARPETS AND CARPET FABRICS

(75) Inventor: Ludo Smissaert, Assebroek (BE)

(73) Assignee: N.V. Michel Van de Wiele, Kortrijk/Marke (BE)

( * ) Notice: Under 35 U.S.C. 154(b), the term of this patent shall be extended for 0 days.

(21) Appl. No.: 09/145,463

(22) Filed: Sep. 2, 1998

(30) Foreign Application Priority Data

Sep. 2, 1997 (BE) ..... 09700712

(51) Int. Cl.[7] ..... D03D 27/10
(52) U.S. Cl. ..... 139/21; 139/398
(58) Field of Search ..... 139/21, 398

(56) References Cited

U.S. PATENT DOCUMENTS

| | | | | |
|---|---|---|---|---|
| 3,519,032 | * | 7/1970 | Sabbe | 139/393 |
| 5,398,730 | * | 3/1995 | Derudder et al. | 139/21 |
| 5,404,917 | * | 4/1995 | Gheysen | 139/398 |
| 5,655,573 | * | 8/1997 | Gheysen et al. | 139/21 |

FOREIGN PATENT DOCUMENTS 1007294 5/1995 (BE) .

OTHER PUBLICATIONS

Ludo Smissaert, Addendum Weave Catalogue 1994, Catalogue, Sep. 21, 1994, pp. 1–19, Michel Van De Wiele, Belgium.

* cited by examiner

*Primary Examiner*—Andy Falik
(74) *Attorney, Agent, or Firm*—James Creighton Wray; Meera P. Narasimhan

(57) ABSTRACT

A method for weaving face-to-face carpets consists of figures formed in an upper fabric and in a lower fabric. Different pile warp threads are woven-in alternately as non-working dead pile in the upper and lower fabrics to form figure-forming pile running from the upper fabric to the lower fabric and vice-versa. A double pile is woven-in with a transition in the weft direction from the figure-forming pile warp thread exiting the lower fabric to a figure-forming pile warp thread exiting the upper fabric. Carpet fabrics with face-to-face carpets separated into upper and lower fabrics is formed of different pile warp threads alternatively woven-in as non-working dead pile in the upper and lower fabrics which protrude as figure-forming pile. A color transition from one figure-forming pile warp thread to another figure-forming pile warp thread results in a woven-in double pile in the fabrics.

10 Claims, 2 Drawing Sheets

METHOD FOR WEAVING FACE-TO-FACE CARPETS AND CARPET FABRICS

BACKGROUND OF THE INVENTION

The invention relates to carpet fabrics and more especially the weaving of face-to-face carpets whereby figures are formed in an upper fabric and a lower fabric by weaving in different pile warp threads alternately as non-working dead pile in the upper or lower fabric, and allowing them to run as figure-forming pile from the upper fabric to the lower fabric and vice versa.

Such carpet fabrics and weaving techniques for manufacturing them are in themselves known.

With face-to-face weaving the dead pile warp threads are woven into the upper and lower fabric, whereas the working pile warp or pile warps form a connection between the upper and lower piece which are then cut through by the cutting device in order to form a velvet carpet. With certain types of carpets (e.g. Chinese) it is desired that the contours of the figures according to a pattern acquire a kind of carving. This effect is achieved by not forming working pile in those places according to the pattern and therefore weaving in all pile warp threads. This is a popular design effect.

Now it occurs with face-to-face woven carpets that carving effects appear in places where this was not desired according to the pattern: namely with certain color transitions in weft direction. When such a color transition in weft direction is to follow a straight line in warp direction then an empty or open stripe is obtained in the carpet. This detracts from the quality of the carpet when a full velvet carpet is desired with an even and tight pile surface.

SUMMARY OF THE INVENTION

According to the invention this problem is resolved by making corrections to the carpet.

With the method for weaving face-to-face carpets whereby figures are formed in an upper fabric and a lower fabric by weaving in different pile warp threads alternately as non-working dead pile in the upper or lower fabric, and allowing them to run as figure-forming pile from the upper fabric to the lower fabric and vice versa, for that purpose, according to the invention, with a transition in weft direction from a pile warp thread out of the lower fabric as figure-forming pile to a pile warp thread out of the upper fabric as figure-forming pile, a double pile is woven in.

It should moreover be noted that the concepts lower fabric and upper fabric are related to a definition whereby a first series of successive pile threads (or pile warp threads) per reed opening belong to the lower fabric and the second series to the upper fabric and that the invention specifically relates to the weaving of face-to-face carpets whereby the number of pile warp threads per reed opening amount to 5 or more, in particular 5, 6, 7, 8, 10 or more.

According to a further characteristic of the invention a double pile is woven in each time when with a transition in weft direction in the lower fabric and in the upper fabric four or more pile warp threads are woven-in in a reed opening. In other words, for example in the case of a 6-pile-warp-thread fabric, in each case with a transition from pile warp thread 1 to pile warp thread 4 or more, from pile warp thread 2 to pile warp thread 5 or more, and from pile warp thread 3 to pile warp thread 6, etc.

According to a first embodiment of the invention a double pile is thus woven in with such successive transitions which lie in a straight line in the warp direction.

According to another embodiment of the invention a double pile is woven in with each such transition.

According to the invention with such a transition either the following figure-forming pile warp thread can then be inwoven in the first reed opening together with the previous figure-forming pile warp thread, or the previous figure-forming pile warp thread is inwoven in the second reed opening together with the following figure-forming pile warp thread.

The invention further provides a carpet fabric with improved properties, consisting of a face-to-face carpet cut apart with in an upper fabric and a lower fabric figures formed of different pile warp threads which are alternately inwoven as non-working dead pile in the upper or lower fabric, and protrude as figure-forming pile from the carpet fabric, in which with a color transition from one pile warp thread as figure-forming pile to another pile warp thread as figure-forming pile a double pile is woven in.

According to a preferred characteristic this is namely the case each time when four or more dead pile warp threads are inwoven in an opening.

Moreover according to one embodiment of the invention the double pile is inwoven with successive color transitions which lie in a straight line in the warp direction, and according to another embodiment of the invention with each color transition.

The invention is further explained hereafter with respect to a 6-pile-warp-thread weaving system and with reference to the attached schematic drawings.

With carpets woven in 5, 7, 8 and 10 pile warp threads or more the conclusions remain the same.

The problem which lies at the basis of the invention consists therein that with the transitions from the pile threads in weft direction pile openings are caused there through the position of the inwoven pile threads. Factors which can influence these pile openings:

1) the number of pile warp threads per reed opening: 5, 6, 7, 8, 10
2) use of a double tight warp in the reed opening, through which the pile threads have even less freedom of movement
3) thickness and type of the pile yarns This problem occurs each time when in weft direction in the pattern a transition from pile thread or pile warp thread 1 to pile thread or pile warp thread 6 is determined. This does not occur when conversely there is a transition from pile warp thread 6 to pile warp thread 1. The phenomenon is also found with transitions 1-4, 1-5, 1-6, 2-5, 2-6, 3-6.

When in a reed tooth i pile warp thread 1 is working pile and in reed tooth i+1 pile warp thread 6 is working pile, then between both pile naps in the lower fabric lie 5 inwoven pile warps (2 for tooth i, and 3 for tooth i+1) for a 6-pile-warp-thread carpet. A similar arrangement is found for the upper fabric. This large number of interjacent, inwoven pile warp threads push the adjacent pile naps away from each other through which an undesired carving arises. This quality detracting effect becomes that much worse the more the number of pile warp threads in the carpet increases. Now there is a general trend to 6 pile warp threads. A trend to 8 and 10, yes even 12 pile warp threads may be expected as a result of the increasing demand for multicolored designs and the ease of development and production that has arisen through the use of CAD systems and electronic jacquard machines.

In order to remedy this problem the invention provides the above described solution. For that purpose according to the pulling through of the pile warp threads in the reed teeth the pile warp thread transitions in weft direction, which are the cause of the adverse effect, will first be determined. With an adverse pile warp thread transition in tooth i to tooth i+1 both pile warp thread 1 and pile warp thread 6 will be selected as working pile in the tooth i, in other words a double pile nap will be woven in tooth i: the existent pile warp thread and the new pile warp thread together. In tooth i+1 the previous pile warp thread and the new pile warp thread can also be allowed to work together.

This is further illustrated on the basis of the attached drawings as follows.

In these drawings:

DETAILED DESCRIPTION OF THE PREFERRED EMBODIMENT

Figure 1:
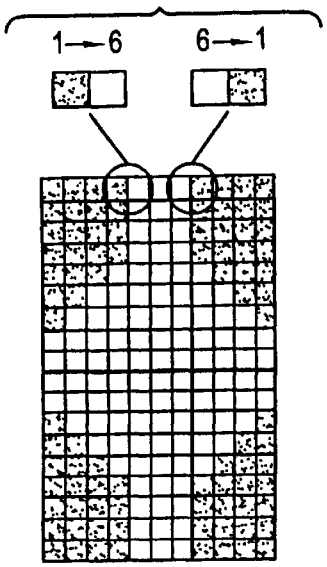
FIG. 1 is a schematic representation of a pointed-paper drawing for a face-to-face carpet in which two pile warp thread transitions are schematically shown.
Figure 2:
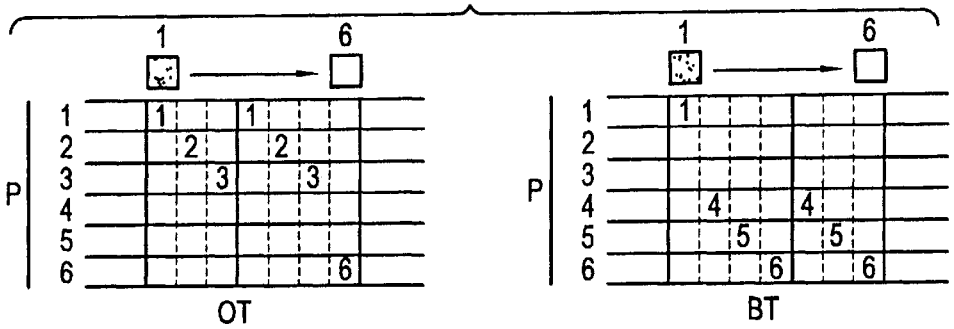
FIGS. 2 and 3 are schematic representations of the positions of the pile threads in the reed openings per tooth and per carpet (lower and upper fabric) with the pile warp thread transitions from FIG. 1.

On the pointed-paper drawing from FIG. 1 a transition from pile warp thread 1 to pile warp thread 6 is verified, as 1→6, shown on the left in the schematic figure. The corresponding position P of the pile threads 1–6 per tooth 1–6 and per carpet (lower fabric OT and upper fabric BT) are shown in FIG. 2.

Between a first pile-forming warp thread (1) which is in the first reed opening on the left and a second pile-forming warp thread (6) which is in the second reed opening on the right, 5 pile threads are woven in. For the lower carpet (OT) 2, 3, 1, 2, 3 and for the upper carpet (BT) 4, 5, 6, 4, 5.

Analogous openings are caused with the following transitions: 1-4, 1-5, 1-6, 2-5, 2-6, 3-6.

Figure 3:
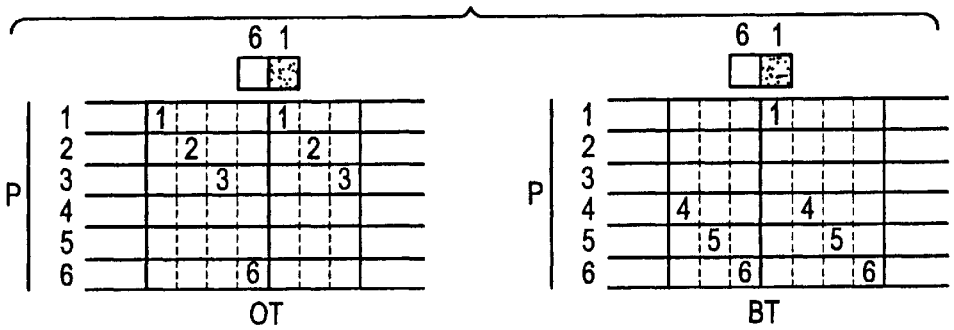

On the pointed-paper drawing from FIG. 1 a transition from pile warp thread 6 to pile warp thread 1 is also verified, as 6→1, shown on the right in the schematic figure. The corresponding position of the pile threads per tooth and per carpet are shown in FIG. 3 in analogous manner to in FIG. 2. With the transitions between pile warp thread 6 and pile warp thread 1 the pile threads are next to each other. There are no inwoven pile threads between these rising pile threads and because of this no openings are created either.

In order to eliminate the pile openings which could arise with transitions 1–6 according to FIG. 2 corrections are made prior to those transitions, through which either in the first reed opening (FIGS. 4, 5), or in the second reed opening (FIGS. 6, 7) weaving is effected with a double pile.

The contour lines are applied on the pointed-paper drawing in another color, whereby that color provides a weave in which both pile warp thread 1 and pile warp thread 6 are raised.

Figure 4:
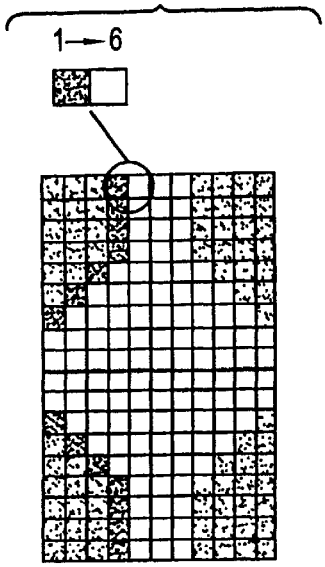
FIGS. 4 and 6 are schematic representations of corrections to the pointed-paper drawings from FIG. 1 according to two embodiments of the invention.
Figure 5:
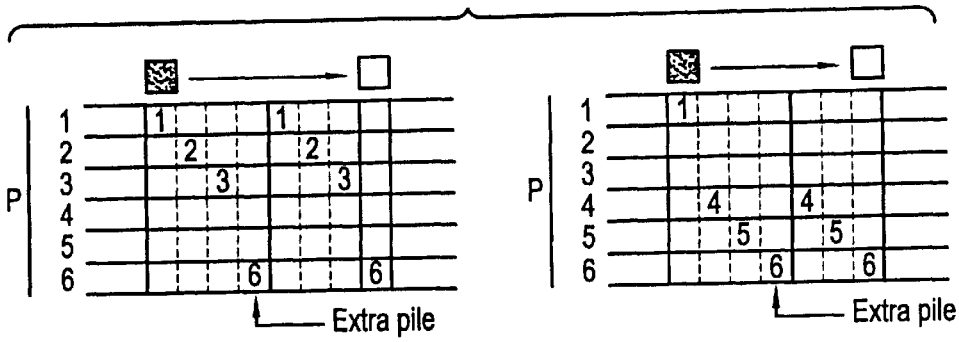
FIGS. 5 and 7 are schematic representations of the positions of the pile threads in the reed openings per tooth and per carpet for corrected pile warp thread transitions according to FIGS. 4 and 6.

With FIG. 4 the contour line is applied on the darker color (pile warp thread 1). Here pile warp thread 6 is selected at the same time as "Extra pile" and weaving in this reed opening will be effected with double pile (FIG. 5).

Figure 6:
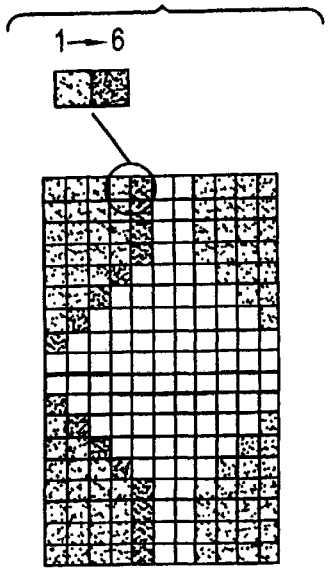
Figure 7:
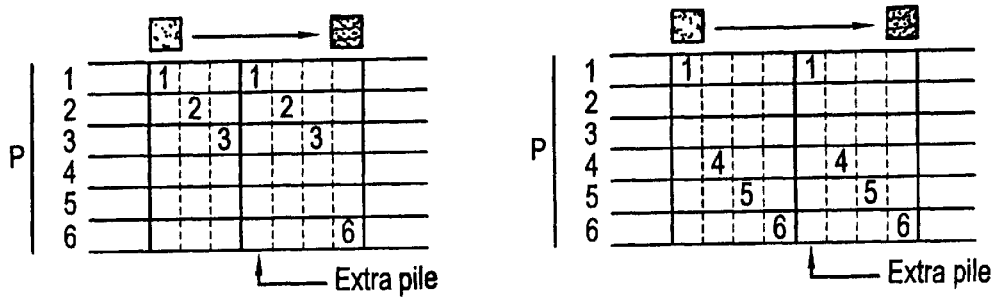

With FIG. 6 the contour line is applied on the lighter color (pile warp thread 6). Here pile warp thread 1 is selected at the same time as "Extra pile" and weaving in this reed opening will be effected with double pile (FIG. 7).

Figure 8A:
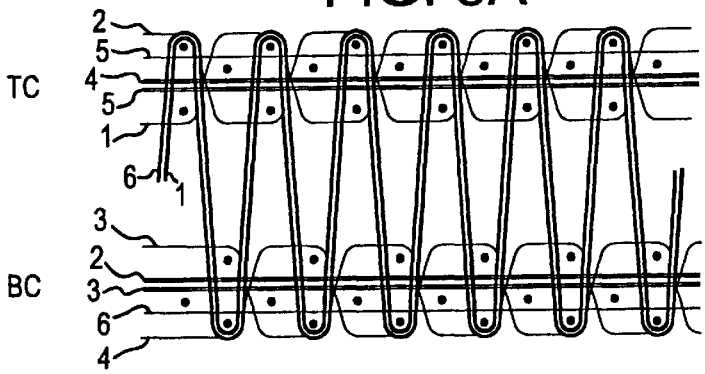
FIGS. 8A and 8B are schematic views of face-to-face double pile woven-in fabrics.
Figure 8B:
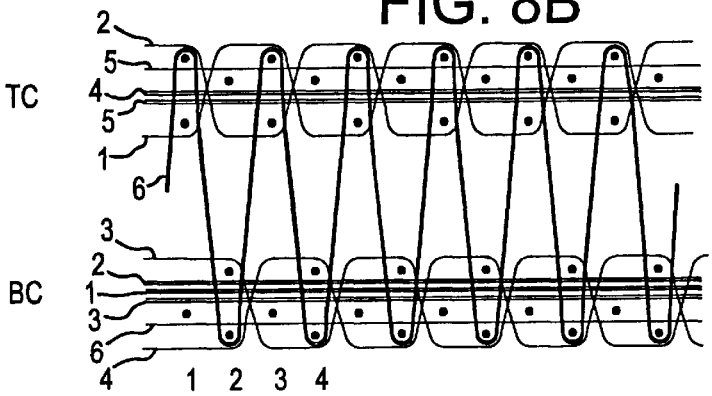

With the method according to the invention as shown in FIGS. 8A and 8B, the gist of it is that in the pointed-paper drawing (design) the pile warp thread transitions in weft direction are verified and with these transitions a new color is added. To this new color in the pointed-paper drawing a lift plan or elementary weaving pattern is added in order to form a double pile nap with the previous and new pile warp thread.

Finding the pile warp thread transitions can be done manually. These days use will however be made of a CAD system for the weaving industry. With these systems the search functions for color transitions in weft direction can be used. More generally an algorithm will be developed in order to find these transitions and to replace them by a new color, to which a correction lift plan is then linked. In this manner the method of the invention can be automated.

By utilizing this method according to the invention, high pile warp thread carpets can be woven which show no undesired carvings.

What is claimed is:

1. A method for weaving face-to-face carpets comprising forming figures in an upper fabric and a lower fabric by weaving in different pile warp threads alternately as non-working dead pile in the upper or the lower fabric, running the pile warp threads as figure-forming pile from the upper fabric to the lower fabric and from the lower fabric to the upper fabric, having plural transitions by changing a weft direction of a pile warp thread exiting the lower fabric as figure-forming pile and a pile warp thread exiting the upper fabric as figure-forming pile thereby weaving-in a double pile.

2. The method of claim 1, further comprising weaving-in four or more dead pile warp threads in first and second reed openings in the lower fabric and in the upper fabric, and wherein the double pile is woven-in with the transitions each time the four or more pile warp threads are woven-in in the reed opening.

3. The method of claim 2, wherein the double pile is woven-in with successive transitions lying in a straight line in the warp direction.

4. The method of claim 2, wherein the double pile is woven-in with each transition.

5. The method of claim 2, wherein with each transition the subsequent figure-forming pile warp thread is woven-in in the first reed opening together with the previous figure-forming pile warp thread.

6. The method of claims 2, wherein with each transition the previous figure-forming pile warp thread is woven-in in the second reed opening together with the subsequent figure-forming pile warp thread.

7. Carpet fabric consisting of a face-to-face carpet comprising an upper fabric and a lower fabric having figures formed of different pile warp threads, the pile warp threads being alternately woven-in as non-working dead pile in the upper or the lower fabric to protrude as figure-forming pile, and a double pile woven-in with color transitions from one pile warp thread protruding as the figure-forming pile to another pile warp thread protruding as the figure-forming pile.

8. The carpet fabric of claim 7, wherein the double pile is formed each time four or more dead pile warp threads are woven-in in an opening in the fabrics.

9. The carpet fabric of claim 8, wherein the double pile is woven-in with successive transitions lying in a straight line in a warp direction.

10. The carpet fabric of claim 8, wherein the double pile is woven-in with each transition.

* * * * *